US010577208B2

(12) United States Patent
Estella et al.

(10) Patent No.: US 10,577,208 B2
(45) Date of Patent: Mar. 3, 2020

(54) APPARATUSES FOR LARGE FORMAT PRINTERS

(71) Applicant: Hewlett-Packard Development Company, L.P., Houston, TX (US)

(72) Inventors: Albert Estella, Sant Cugat del Valles (ES); Diego Lopez Ubieto, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 146 days.

(21) Appl. No.: 15/569,867

(22) PCT Filed: Jul. 20, 2015

(86) PCT No.: PCT/EP2015/066795

§ 371 (c)(1),
(2) Date: Oct. 27, 2017

(87) PCT Pub. No.: WO2017/012666

PCT Pub. Date: Jan. 26, 2017

(65) Prior Publication Data

US 2018/0118492 A1 May 3, 2018

(51) Int. Cl.
*B65H 16/06* (2006.01)

(52) U.S. Cl.
CPC ... *B65H 16/06* (2013.01); *B65H 2301/41306* (2013.01); *B65H 2403/514* (2013.01); *B65H 2403/60* (2013.01); *B65H 2801/36* (2013.01)

(58) Field of Classification Search
CPC ..... B65H 16/06
(Continued)

(56) References Cited

U.S. PATENT DOCUMENTS 3,052,422 A * 9/1962 Moser ..... B65H 16/06 242/596
4,239,404 A 12/1980 DeFilipps et al.
(Continued)

FOREIGN PATENT DOCUMENTS

JP H06115729 A 4/1994
JP 2001080803 3/2001
(Continued)

OTHER PUBLICATIONS

Hellmuth, N. et al., "uper Wide-Format Dedicated Roll-to-Roll UV Printer" (Web Page), Nov. 2010, 62pages.
(Continued)

*Primary Examiner* — Anthony H Nguyen
(74) *Attorney, Agent, or Firm* — HP Inc. Patent Department

(57) ABSTRACT

An apparatus (100) for a large format printer (400) to support a spindle (102) of a roll of media comprises at least one supporting member (104, 104*a*, 104*b*, 104*c*) to support the weight of the spindle (102) when the spindle is loaded into the apparatus (100). The apparatus also comprises a cradle (108) to support the spindle (102) as it is loaded onto or unloaded from the at least one supporting member (104). The cradle (108) is moveable between a first position to receive the spindle (102) and a second position when the spindle is supported by the at least one supporting member (104). The apparatus also comprises a shock absorbing member (110) in contact with the cradle (108). The cradle moves between the first and second positions as the spindle (102) is loaded into the apparatus (100) and the shock absorbing member (110) absorbs kinetic energy of the cradle (108) as it moves from the first position to the second position.

15 Claims, 7 Drawing Sheets

(58) Field of Classification Search
USPC ..... 400/611
See application file for complete search history.

(56) References Cited

U.S. PATENT DOCUMENTS

| | | | | |
|---|---|---|---|---|
| 4,817,882 | A | 4/1989 | Brewer et al. | |
| 4,895,314 | A * | 1/1990 | Thievessen | B65H 19/126 242/559.1 |
| 5,320,296 | A * | 6/1994 | Ozcariz | B65H 16/06 242/559.4 |
| 5,709,481 | A | 1/1998 | Hinojosa | |
| 5,906,333 | A * | 5/1999 | Fortuna | B65H 19/1836 242/554.5 |
| 6,502,780 | B2 | 1/2003 | Harris et al. | |
| 6,533,212 | B1 * | 3/2003 | Tafel, II | B65H 19/1815 242/554.6 |
| 6,820,837 | B2 * | 11/2004 | Long | B65H 19/126 242/554.2 |
| 7,036,923 | B2 | 5/2006 | Takagi et al. | |
| 8,282,296 | B2 * | 10/2012 | Colombi | G07G 5/00 242/324 |
| 2001/0052559 | A1 | 12/2001 | Inana et al. | |
| 2011/0076083 | A1 | 3/2011 | Tsurui et al. | |
| 2013/0108346 | A1 * | 5/2013 | Preliasco | B41J 17/02 400/611 |
| 2015/0034758 | A1 * | 2/2015 | Acciari | B65H 23/1825 242/555.4 |

FOREIGN PATENT DOCUMENTS

| | | |
|---|---|---|
| JP | 2002241006 | 8/2002 |
| JP | 5009769 | 8/2012 |

OTHER PUBLICATIONS

Unknown, "Lithography", Occupational Safety & Health Administration, Retrieved from Internet, May 22, 2015, 11 pages.

* cited by examiner

APPARATUSES FOR LARGE FORMAT PRINTERS

BACKGROUND

Large format printers are used in applications where a large print surface is needed, for example printed signage or displays such as billboards. Large format printers may print on a range of media including paper, wall coverings, vinyl, canvas and film.

Such media is often supplied in rolls, comprising layers of media wrapped around a spindle. Each roll may be 300 kg or more in weight and has to be lifted and held securely by the spindles so that the media can be fed into the printer.

BRIEF DESCRIPTION OF DRAWINGS

Examples will now be described, by way of non-limiting example, with reference to the accompanying drawings, in which.

DETAILED DESCRIPTION

Figure 1:
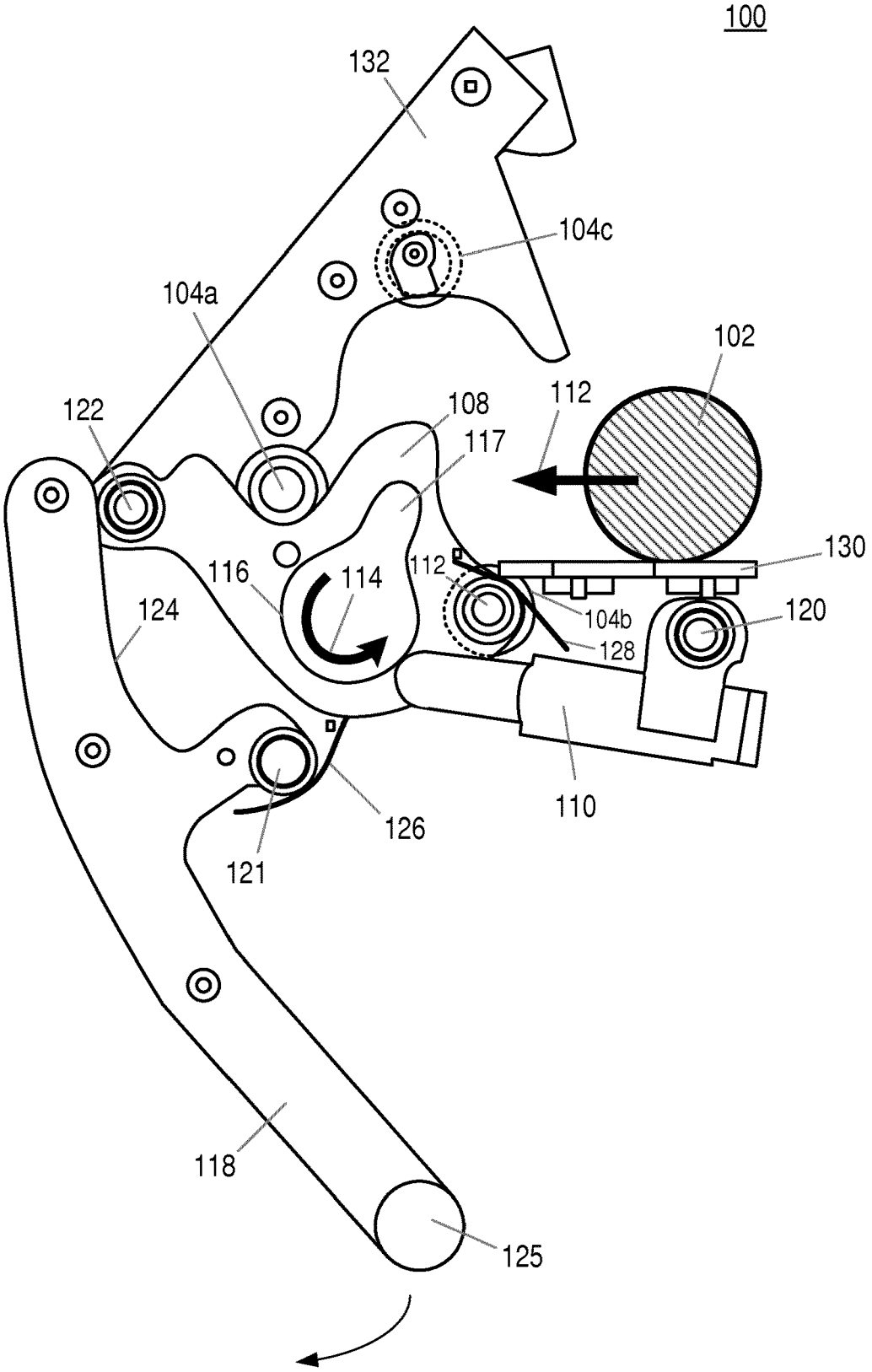
FIG. 1 shows a spindle being loaded into an example of an apparatus for a large format printer to support a spindle of a roll of media.
Figure 2:
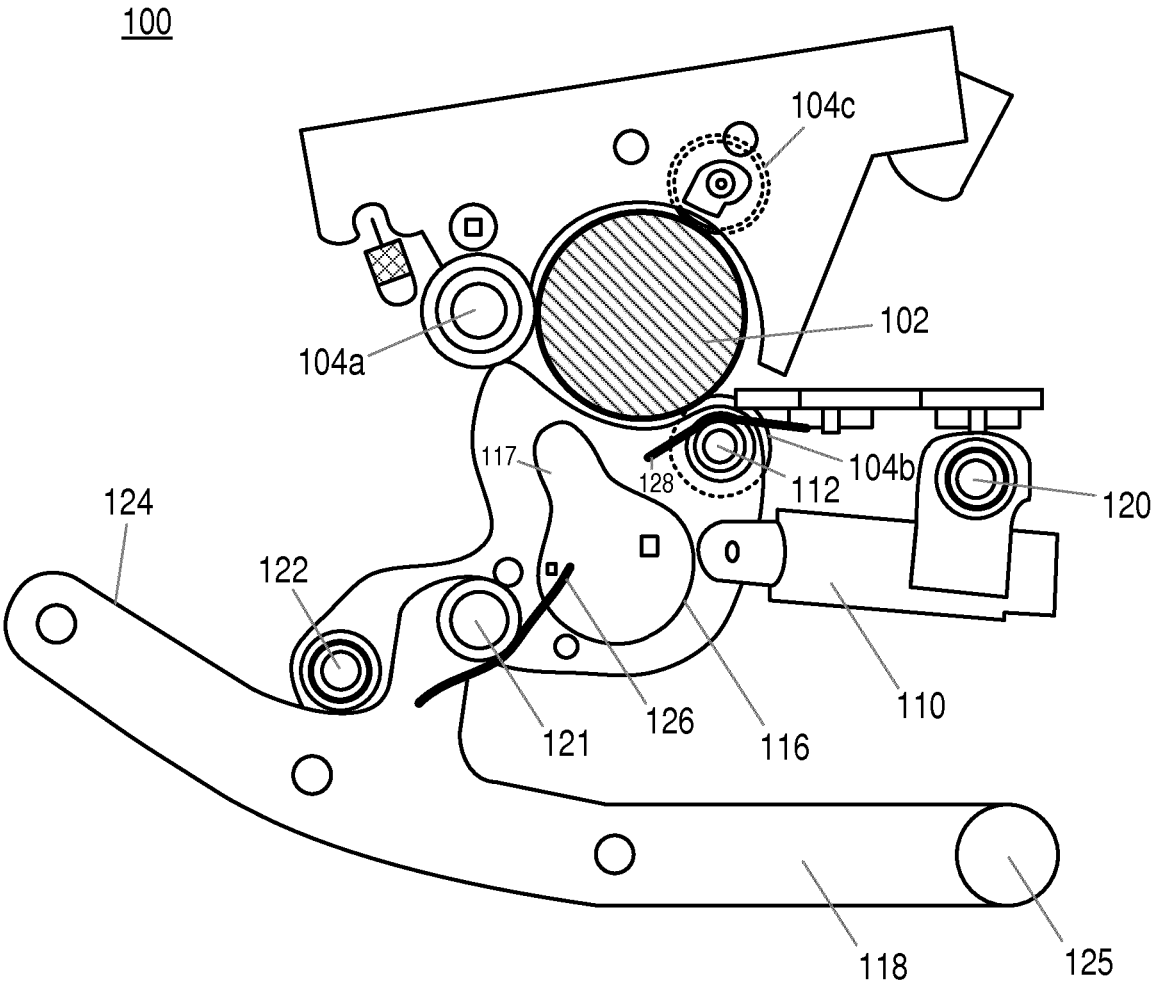
FIG. 2 is an example apparatus for a large format printer to support a spindle of a roll of media.

FIG. 1 shows an example apparatus 100, for example for use with a large format printer, to support a spindle 102 of a roll of media. The apparatus comprises at least one supporting member 104 to support the weight of a spindle 102 when a spindle is loaded into the apparatus, and a cradle 108 to support a spindle 102 as it is being loaded onto or unloaded from the at least one supporting member 104. The cradle 108 is moveable between a first position to receive the spindle (as illustrated in FIG. 1) and a second position when the spindle is supported by the at least one supporting member 104 (as shown in FIG. 2).

The apparatus further comprises a shock absorbing member 110, in contact with the cradle 108. The cradle 108 moves between the first and second positions as the spindle is loaded onto the apparatus and the shock absorbing member 110 absorbs kinetic energy of the cradle 108 as it moves from the first position to the second position.

In the example of FIG. 1 the supporting member 104 comprises a set of three supporting members 104*a*, 104*b*, 104*c*, for supporting a spindle in its loaded position (e.g. during use). The supporting members 104 may comprise, for example, bearings for enabling the spindle to rotate during use. It is noted that other types of supporting members may be used, or a different number of supporting members.

FIG. 1 shows the cradle 108 in what is referred to herein as the first position (or the loading/unloading position). When loading a spindle 102 into apparatus 100, the spindle is rolled into the cradle 108, for example onto a curved surface of the cradle 108, in the direction of arrow 112 in FIG. 1. When the spindle 102 makes contact with the cradle 108, the weight of the media on the spindle 102 causes the cradle 108 to move in the direction of arrow 114. As noted above, the shock absorbing member 110 is in contact with the cradle 108 and is compressed by the cradle as the cradle moves, absorbing some of the kinetic energy of the spindle 102. The cradle moves in the direction 114 until the spindle comes to rest on the supporting members 104. At this point the spindle is loaded and the weight of the spindle rests on at least one of the supporting members 104. The cradle 108 rests below the spindle, as shown in FIG. 2. The position of the cradle as shown in FIG. 2 is what is referred to herein as the second position.

During loading, the weight of the spindle 102 and associated media roll may cause the cradle 108 to rotate with high angular momentum. Without the cradle and the shock absorbing member, this momentum would ordinarily be transferred in a sharp impact to the support members 104 which, over time, may result in wear of the supporting members 104.

Thus, the cradle 108 and a shock absorbing member 110 may be used in combination to absorb at least some of the kinetic energy of a spindle 102 and therefore reduce the effects of impacts on supporting members 104 as the spindle is loaded, which may help prevent subsequent failure of the supporting members.

In some examples, as mentioned above the supporting members 104 may be bearings or struts to bear the weight of the spindle 102.

In some examples, the shock absorbing member 110 is based on a hydraulic device, such as a hydraulic damping device. In other examples, the shock absorbing member 110 may be a spring design, such as a coil or leaf spring, which acts to absorb the movement of the cradle as the cradle rotates and compresses the spring. In another example the shock absorbing member 110 may comprise a combination of a spring/damper arrangement.

In some examples, the cradle 108 may be pivotable about a first axis 112 as the cradle moves between the first and second positions. The first axis 112 may be aligned with the axis of the support member 104*b*. In some examples, the degree of compression of the shock absorbing member 110 may be controlled by a cam surface 116 of a cam member 117 that forms part of the cradle 108. The cam surface 116 controls the compression of the shock absorbing member 110 as the cradle 108 (and cam member 117) pivots from the first position to the second position, about the first axis 112.

Figure 3A:
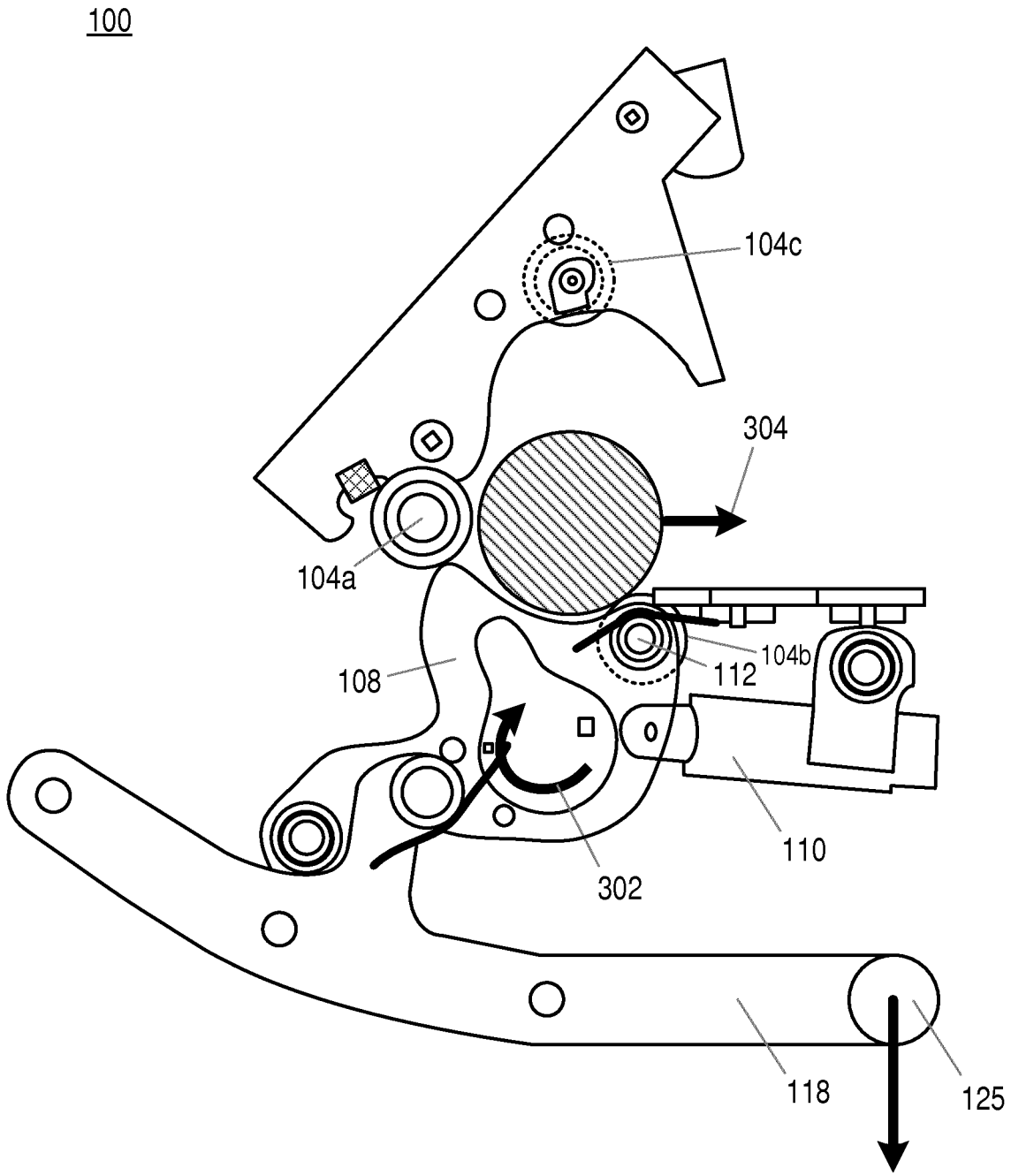
FIGS. 3*a* and 3*b* show an example of a spindle being ejected from an apparatus for a large format printer to support a spindle of a roll of media.
Figure 3B:
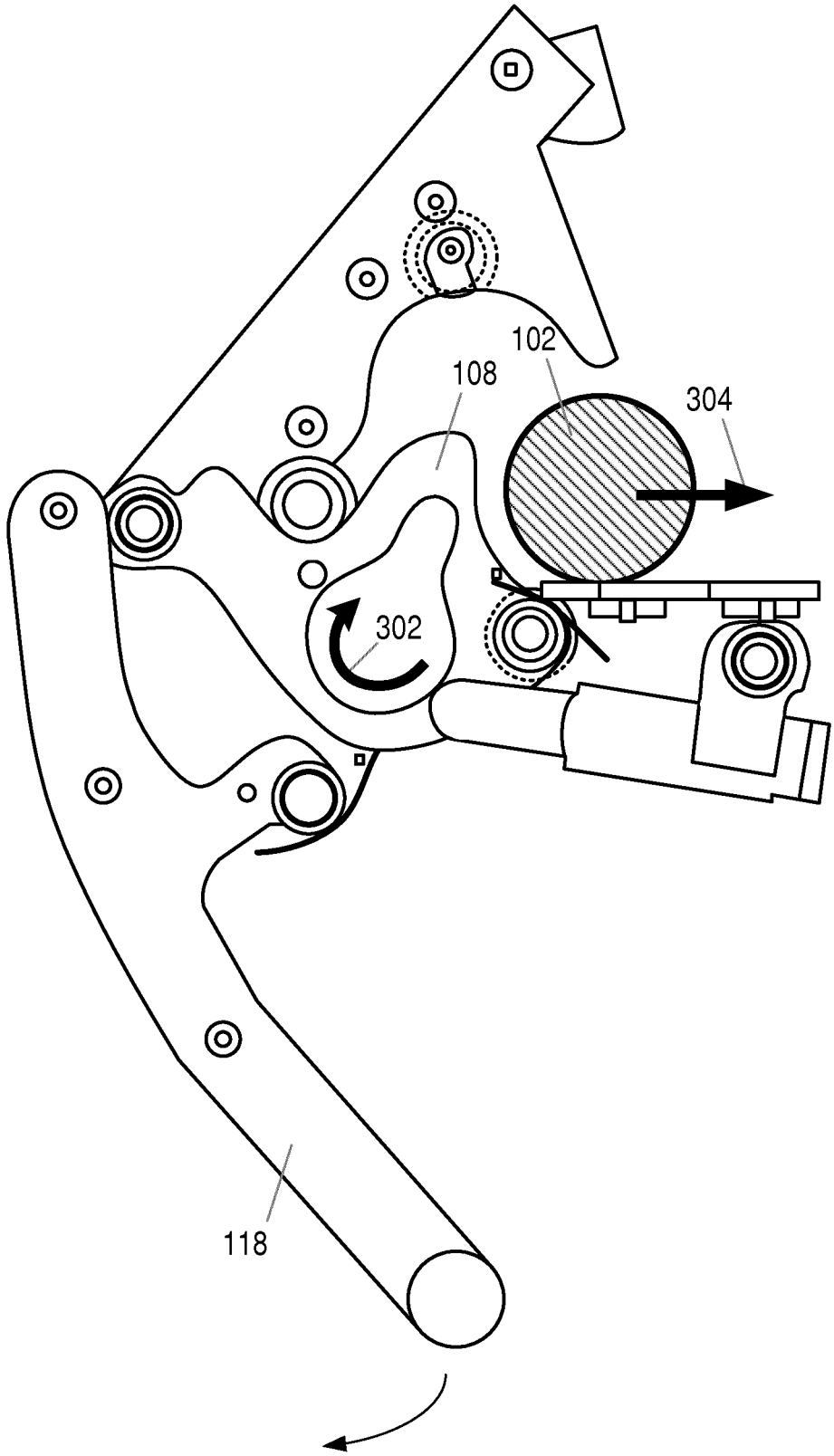

In some examples, the apparatus further comprises a lever 118, mechanically coupled to the cradle 108. In one example, the spindle 102 is unloaded from the apparatus by applying a downward force on the lever 118. In one example the lever 118 comprises a foot pedal 125, for example in an apparatus where the lever 118 is to be operated by foot. The application of a downward force on lever 118 causes the lever 118 to pivot about a second axis 121, which in turn causes the cradle 108 to transition from the second position to the first position, as the cradle 108 pivots about the first axis 112. This transition (i.e. unloading) is shown in FIGS. 3*a* and 3*b* where the force on lever 118 causes rotation of the cradle 108 in the direction of arrow 302. The cradle moves (or rotates) until the angle of the cradle 108 is such that the spindle 102 is ejected from the cradle in the direction of arrow 304.

At the point where the spindle is ejected, as shown in FIG. 3*b*, the cradle is thus returned to the first position as was shown in FIG. 1. In the first position, the lever 118 is depressed and the cradle 108 is at an angle so as to eject the spindle 102 (e.g. the spindle rolls out under its own weight) and/or receive a new spindle.

During loading (i.e. the reverse of the process described above), because the cradle 108 is mechanically coupled to the lever 118, the motion of the cradle 108 from the first position to the second position causes the lever 118 to rotate about its pivot, i.e. the second axis 121, until the lever 118 is in a raised position as shown in FIG. 2.

The spindle 102 can therefore be pushed onto the cradle 108 to load the media into position and subsequently removed by applying force to the lever 118. With this arrangement, a roll of media (e.g. paper) weighing 300 kg or more can be loaded and unloaded into position with reduced effort, for example by a single person, negating the need for two operators. Thus, in this example it can be seen that a pivotable cradle and lever can be used to load and unload heavy rolls of media to a large format printer in an efficient and ergonomic way.

In some examples, the cradle 108 is mechanically connected to the lever 118 by means of a rigid connection between the cradle and the lever. In other examples, the cradle 108 comprises a cam follower 122 and the lever comprises a cam surface 124. During loading (i.e. as the cradle 108 is moved from the first position shown in FIG. 1 to the second position shown in FIG. 2) the cam follower 122 moves along the cam surface 124, and as a result, the lever 118 rotates anti-clockwise about its pivot, i.e. the second axis 121, such that a foot pedal 120 moves from the downward position in FIG. 1, to the upward position in FIG. 2 (as the lever 118 pivots about its axis 121).

When the apparatus is unloaded (i.e. the cradle 108 is moved from the second position to the first position), the act of applying a force to the lever 118 raises the cam surface 124, which moves the cam follower 122 upwards and along the cam surface 124, such that the cradle 108 is rotated from the second position to the first position. As such, the cam follower 122 and the cam surface 124 cooperate to control movement of the cradle between the first position and the second position.

Thus, in some examples, the cradle 108 is pivotable about a first axis 112 and the lever 118 is pivotable about a second axis 121. Axes 112 and 121 are fixed in place and thus the range of motion of the cradle 108 and the lever 118 is defined, in some examples, by the cam surface 124, the location of the pivot points, and the shape of the cradle 108 and lever 118. For example, in FIG. 2, the rotation of the cradle 108 in the anti-clockwise direction about pivot 112 is restricted, amongst other things, by the length of the cam surface 124. In FIG. 1, the rotation of the cradle in the clockwise direction is defined by the cam surface 124 (and may be restricted by how far the lever 118 can be depressed). Therefore, in some examples, the cam surface 124 defines a range of movement between the first and second positions.

In some examples, the apparatus comprises a first biasing means 126 for biasing the lever 118 in a direction such that the lever is urged into an upwards position as shown in FIG. 2 (such that the lever is in position to be operated). In one example, the biasing means 126 may be a spring or coil.

In some examples, the apparatus comprises a second biasing means 128 for biasing the cradle 108 towards the first position (as shown in FIG. 1).

In some examples, the lever 118 is extended so as to amplify a force applied by a user to move the cradle from the second position to the first position. In this way a large roll, for example 100-300 kg or more, can be ejected from the apparatus by a single operator.

In further examples, the apparatus may comprise a platform 130, adjacent to the cradle 108 to support the spindle 102 during loading and/or unloading of the spindle. In this way, the roll of paper may be lifted so that the spindle rests on the platform 130 and can then be loaded (e.g. rolled) onto the cradle 108 by a single operator.

In some examples, the cradle 108 is pivotally attached to the underside of the platform 130. In other examples, the shock absorbing member 110 may be attached to the underside of the platform 130, adjacent to the cradle. In some examples, the shock absorbing member 110 is pivotable about a third axis, 120. This enables the shock absorbing member to follow the movement of the cradle 108 as the spindle 102 is loaded and unloaded. This compensates for the fact that, in this example, the shock absorbing member is not necessarily moving along the linear axis of the shaft of the shock absorbing member.

In some examples, once the spindle 102 has been loaded by the cradle 108 onto the supporting member(s) 104, the spindle can be held in place by a latch 132 (or clasp) which secures the spindle in place on the supporting member(s) 104 when the spindle is loaded (and the cradle is in the second position). In one example the latch may house a supporting member 104*c*, such as a bearing, to help support the spindle during any upwards motion caused by vibration of the printer, or rotation of other supporting members 104. In some examples, the latch 132 is used to support and steady the spindle in the cradle, for example during use, to prevent rocking of the spindle during the print process. In further examples, the latch 132 may also act as a locking mechanism and prevent the cradle from pivoting between the second position and the first position when the latch 132 is fastened over the spindle.

In one example, the latch 132 may be pivotably moveable between a locked position with the spindle 102 secured and the cradle 108 locked in the second position, and an unlocked position to enable the cradle 108 to be moved from the second position to the first position.

Figure 4:
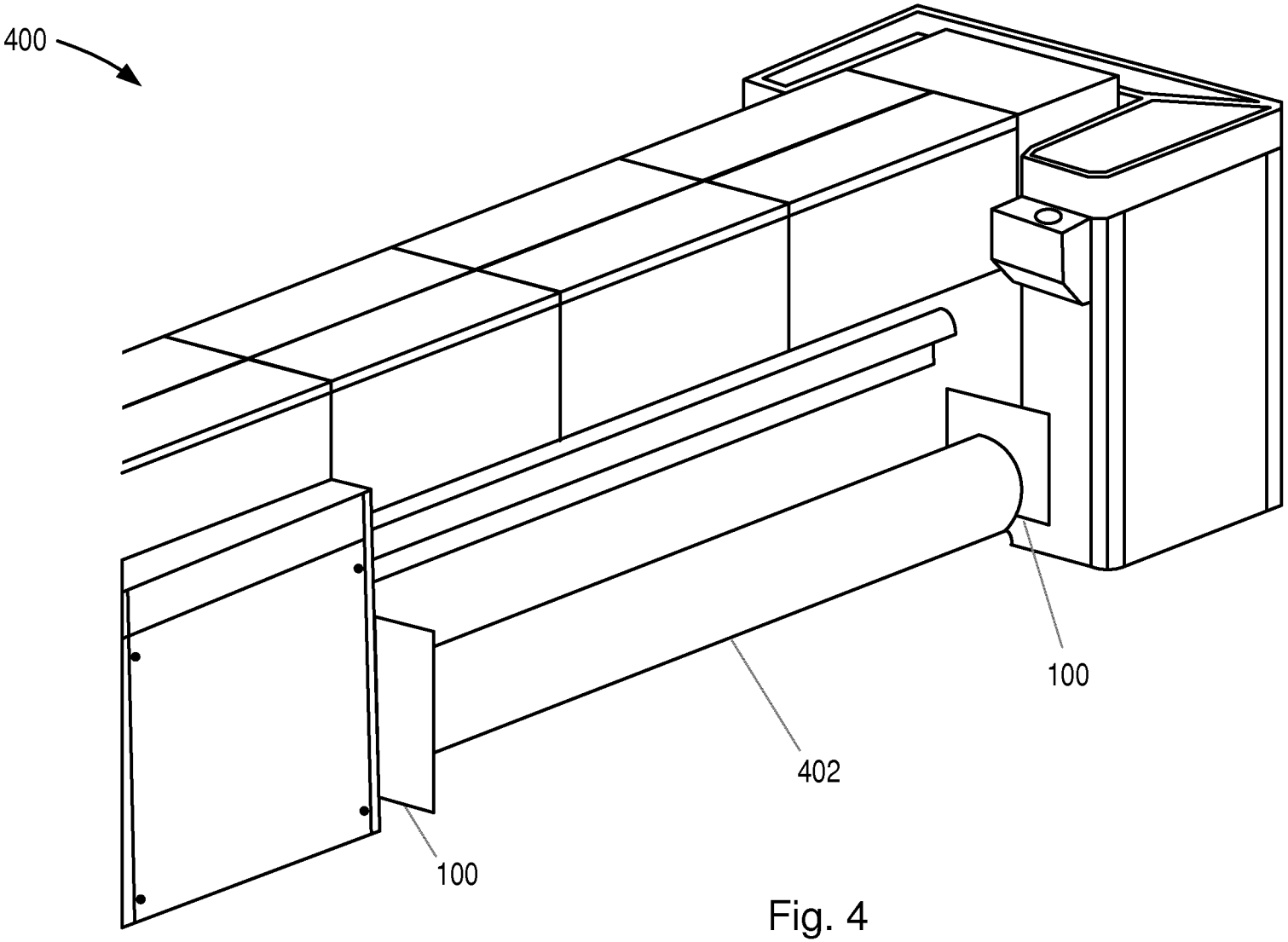
FIG. 4 shows a pair of example apparatus, in use on a large format printer.

FIG. 4 shows a pair of apparatus 100 in use on a large format printer 400, either side of a roll of print media 402, each holding a respective spindle (or respective ends of the same spindle) of the print media in place for printing. In such an example, a mechanism may be provided (not shown), for mechanically coupling the lever 118 of one apparatus 100 with the lever 118 of another apparatus 100, such that the operation of one lever 118 causes both levers to eject their respective spindles (or respective ends of the same spindle) at the same time during an unloading operation. In another example, a lever 118 of one apparatus 100 is mechanically coupled to the cradles of both apparatus 100, such that one of the apparatus 100 does not comprise a lever, but is instead operated by the lever 118 of the other apparatus in the pair.

Figure 5:
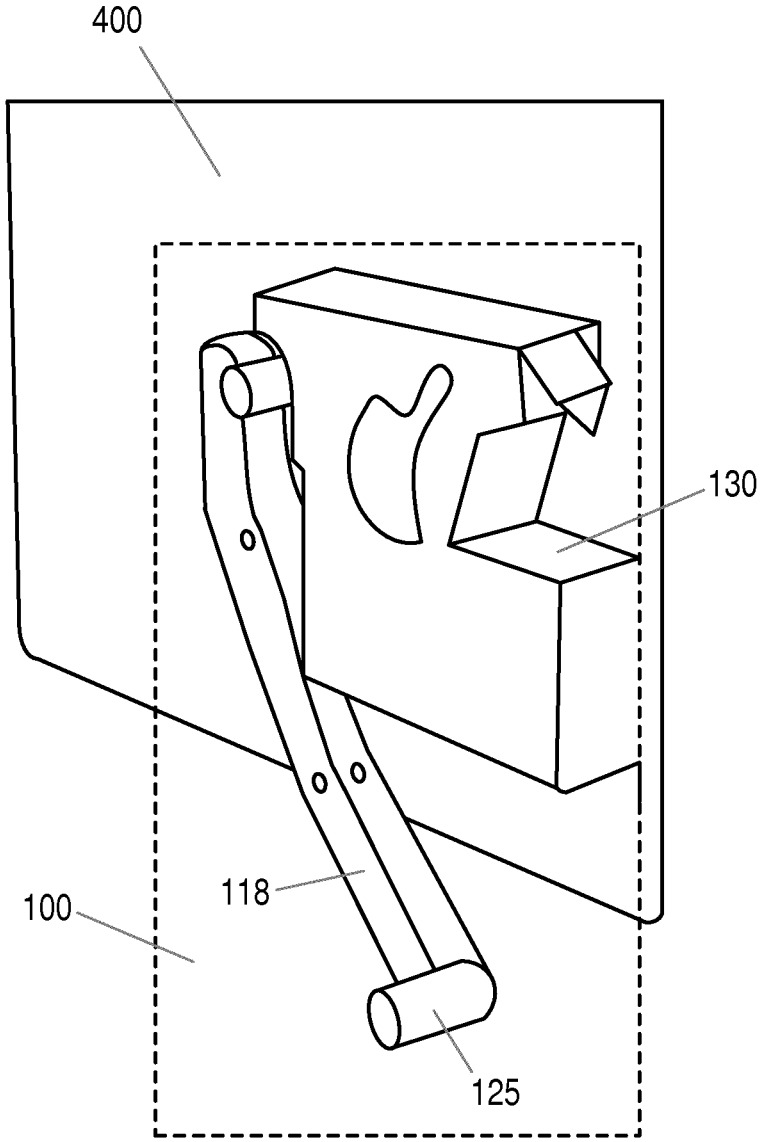
FIG. 5 shows an example apparatus installed on the side of a large format printer.

FIG. 5 shows a schematic close up view of an example of the apparatus 100 as installed on the side of the large format printer 400.

Figure 6:
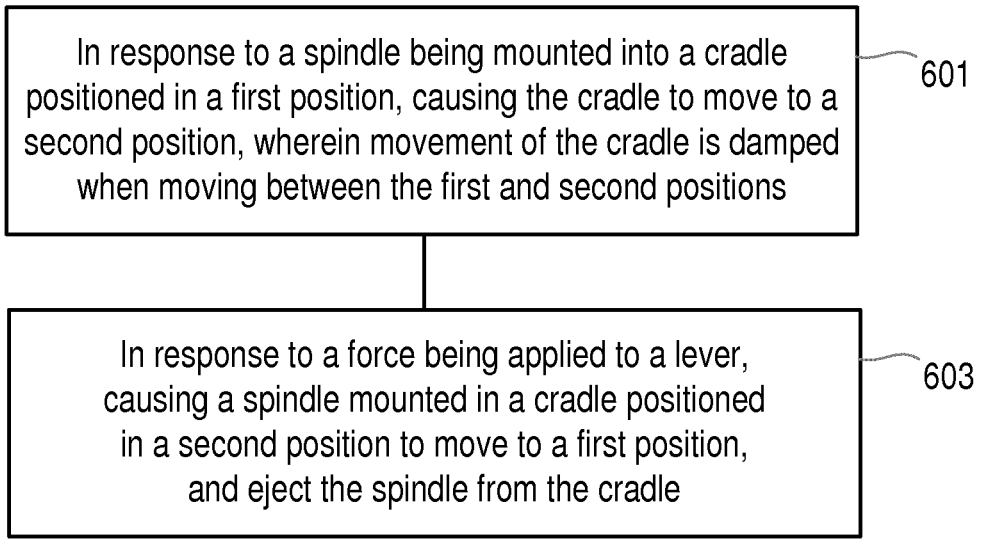
FIG. 6 shows an example of a method.

Referring to FIG. 6, according to another example, there is provided a method for loading and unloading a roll of media into and out of a printer, wherein the roll of media comprises a spindle. The method of loading 601 comprises: in response to a spindle being mounted into a cradle positioned in a first position; causing the cradle to move to a second position; wherein movement of the cradle is damped when moving between the first and second positions. The method of unloading 603 comprises: in response to a force being applied to a lever, causing a spindle mounted in a cradle positioned in a second position to move to a first position, and eject the spindle from the cradle.

While the method, apparatus and related aspects have been described with reference to certain examples, various modifications, changes, omissions, and substitutions can be made without departing from the spirit of the present disclosure. It should be noted that the above-mentioned examples illustrate rather than limit what is described herein, and that many alternative implementations may be designed without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. An apparatus for a large format printer to support a spindle of a roll of media, the apparatus comprising:

at least one supporting member to support the weight of a spindle when a spindle is loaded into the apparatus;

a cradle to support a spindle as it is being loaded onto or unloaded from the at least one supporting member, wherein the cradle is moveable between a first position to receive the spindle and a second position when the spindle is supported by the at least one supporting member; and a shock absorbing member in contact with the cradle;

wherein the cradle moves between the first and second positions as the spindle is loaded into the apparatus, and wherein the shock absorbing member absorbs kinetic energy of the cradle as it moves from the first position to the second position.

2. An apparatus as claimed in claim 1, wherein the cradle is pivotable about a first axis as the cradle moves between the first and second positions.

3. An apparatus as claimed in claim 2, wherein the cradle comprises a cam surface to control compression of the shock absorbing member as the cradle pivots from the first position to the second position.

4. An apparatus as claimed in claim 1, comprising a lever mechanically coupled to the cradle, and wherein the cradle is moveable between the second position and the first position in response to a force being applied to the lever.

5. An apparatus as claimed in claim 4, wherein the cradle comprises a cam follower and the lever comprises a cam surface, the cam follower and cam surface cooperating to control movement of the cradle between the second position and the first position.

6. An apparatus as claimed in claim 5, wherein the cam surface defines a range of movement between the first and second positions.

7. An apparatus as claimed in claim 4, wherein the lever is pivotable about a second axis.

8. An apparatus as claimed in claim 7, comprising a first biasing means for biasing the lever in a direction such that the cradle is biased towards its second position.

9. An apparatus as claimed in claim 4, wherein the lever is extended so as to amplify a force applied by a user to move the cradle from the second position to the first position.

10. An apparatus as claimed in claim 1, comprising a platform adjacent to the cradle to support a spindle during a loading/unloading operation.

11. An apparatus as claimed in claim 10, wherein the cradle is pivotally attached to the underside of the platform.

12. An apparatus as claimed in claim 10, wherein the shock absorbing member is attached to the underside of the platform, adjacent to the cradle.

13. An apparatus as claimed in claim 12, wherein the shock absorbing member is pivotable about a third axis.

14. An apparatus as claimed in claim 1, comprising a clasp to secure the spindle when the spindle is loaded into the apparatus.

15. A method for loading and unloading a roll of media into and out of a printer, the roll of media comprising a spindle, wherein:

loading comprises:

in response to a spindle being mounted into a cradle positioned in a first position;

causing the cradle to move to a second position;

wherein movement of the cradle is damped when moving between the first and second positions; and wherein unloading comprises:

in response to a force being applied to a lever, causing a spindle mounted in a cradle positioned in a second position to move to a first position, and eject the spindle from the cradle.

* * * * *